United States Patent [19]

Mikiya et al.

[11] Patent Number: 4,933,999

[45] Date of Patent: Jun. 19, 1990

[54] MASSAGE-ACTION SHOWER HEAD AND MASSAGING/SHOWER APPARATUS

[75] Inventors: Toshio Mikiya; Kuniaki Shibuya, both of Tokyo, Japan

[73] Assignee: Nikki Co., Ltd., Tokyo, Japan

[21] Appl. No.: 281,751

[22] Filed: Dec. 9, 1988

[30] Foreign Application Priority Data

Dec. 16, 1987 [JP] Japan ..... 62-190997[U]
Sep. 19, 1988 [JP] Japan ..... 63-122509[U]

[51] Int. Cl.[5] ..... B05B 15/06

[52] U.S. Cl. ..... 4/568; 4/615; 239/274; 239/283; 239/381; 239/413; 239/446

[58] Field of Search ..... 4/542, 567, 568, 615; 128/66; 239/274, 282, 283, 285, 380, 381, 383, 407, 413, 443–449

[56] References Cited

U.S. PATENT DOCUMENTS 3,802,422 4/1974 Hurst ..... 128/66
3,913,839 10/1975 Wilson ..... 239/444 X
3,958,756 5/1976 Trenary et al. ..... 239/381
4,224,700 9/1980 Bloys ..... 128/66 X
4,441,488 4/1984 Macabee ..... 128/66
4,592,100 6/1986 Robertson et al. ..... 128/66 X
4,629,125 12/1986 Liu ..... 239/383 X
4,637,080 1/1987 Hutchinson ..... 128/66 X
4,733,818 3/1988 Aghnides ..... 239/428.5
4,733,819 3/1988 Aghnides ..... 239/428.5

FOREIGN PATENT DOCUMENTS 2068778A 8/1981 United Kingdom .
2089684A 6/1982 United Kingdom .

*Primary Examiner*—Andres Kashnikow
*Assistant Examiner*—William Grant
*Attorney, Agent, or Firm*—Nixon & Vanderhye

[57] ABSTRACT

A massage-action shower head comprising a housing provided with a hot water entrance, a plurality of bores through which hot water is showered and a hole through which mixture of hot water and air is jetted, a first passage line formed in said housing and being capable of communicating the hot water entrance with the plural hot water showering bores, a second passage line formed in said housing and being capable of communicating the hot water entrance with the hot water jetting hole, an air introducing means provided in said housing to supply air from outside to said second passage line, and a changeover means provided under water for communicating said hot water entrance with at least one of the first and second passage lines.

11 Claims, 11 Drawing Sheets

MASSAGE-ACTION SHOWER HEAD AND MASSAGING/SHOWER APPARATUS

BACKGROUND OF THE INVENTION

1. Field of the Invention

The present invention relates to a shower head for jetting hot water to a bathing person, and more particularly, to a shower head capable of not only applying shower on a bathing person, but also giving message effect to the person.

2. Description of the Related Art

The conventional massage-action shower head was of the type that hot water was discharged outside through the shower head by a predetermined pressure to add a stimulus or massage effect to the skin of a bathing person in a bathtub by the hot water thus discharged, and that a housing in which nozzles and a pump had been incorporated was immersed in hot water in the bathtub.

However, the shower head of this type could not discharge air-contained hot water but shower only hot water. Therefore, the massage effect attained by the conventional shower head to add to the human body was low.

SUMMARY OF THE INVENTION

The present invention is therefore intended to eliminate the above-mentioned drawbacks.

An object of the present invention is to provide a massage-action shower head for enabling the person to select any of the jetting and showering of hot water to give both of massaging and showering effects and also to provide a device used to create a jet stream of hot water to add massage effect to the human body wherein the manner of discharging hot water can be changed when the shower head is attached to and detached from the device and even a strong jetting of hot water like the jet stream can be attained in the hot water in the bathtub with safety.

According to the present invention, there can be provided a massage-action shower head comprising a housing having an entrance for hot water and a face through which hot water is jetted outside, said face being provided with a plurality of hot water showering bores and a hot water jetting hole; a first passage line formed in the housing and being capable of communicating the hot water entrance with the plural hot water showering bores; a second passage line formed in the housing and being capable of communicating the hot water entrance with the hot water jetting hole; an air introducing means provided in the housing to supply air from outside to the second passage line; and a changeover means provided under water for communicating the hot water entrance with at least one of the first and second passage lines.

When the changeover means is operated by hand to hot water supplied through the hot water entrance to the first passage line in the case of the above-described massage-action shower head, hot water can be showered onto any position in the bathtub through the hot water showering bores, passing through the first passage line. When the hot water entrance is switched to the second passage line by means of the changeover means, hot water can be mixed with air introduced through the air intake hole due to ejector effect while hot water is passing through the second passage line, and a mixture of hot water and air can be thus jetted as a strong jet stream of hot water through the hot water jetting hole. The bathing person can select his desired manner of discharging hot water by operating the changeover means, as described above, to enjoy massage effect attained by his selected manner of discharging hot water.

According to the massage-action shower head of the present invention, therefore, the bathing person can select his desired hot water discharging manner to enjoy any of massage and shower effects. Particularly, the shower head has such a structure as enables hot water to be mixed with air. Therefore, the massage effect attained by this shower head is extremely high. In addition, this shower head is quite advantageous because it enables the bathing person to enjoy both of massage and shower effects.

According to the present invention, there can be provided a device used to generate a jet stream of hot water to add massage effect to the bathing person, said device comprising a shower head having an entrance for hot water and a face through which hot water is discharged outside, said face including a plurality of bores through which hot water is showered and a hole through which hot water is jetted; a changeover lever projected outside from the shower head and serving to communicate the hot water entrance with at least one of the hot water showering bores and the hot water jetting hole; a holder fixed to the wall-like object and detachably holding that side of the shower head opposite to the hot water discharging face thereof; and a means formed in the holder for switching the changeover lever to different positions when the shower head is attached to and detached from the holder.

The holder is previously fixed to the inner face of the bathtub under the surface of hot water therein. The holder is provided with a means for switching the changeover lever and when the shower head is inserted into the holder, holding the change-over lever in the switching means, therefore, the changeover lever is rotated by the switching means. When the inserting of the shower head into the holder is finished, the changeover lever can be rotated to a position where hot water can be jetted as a jet stream. In other words, the shower head is under such a state that it can create a jet stream of hot water in the bathtub when its inserting into the holder is finished.

When the shower head is pulled out of the holder, the changeover lever is reversely rotated by the switching means to return to its original position where hot water is showered. The bathing person can enjoy the showering of hot water accordingly.

The shower head of the type, which can jet hot water to give massage effect to the user, must be designed such that it can be used also outside the bathtub. Therefore, when the changeover lever is set at a neutral position in a groove cut in the holder, the operation mode is changed to the massage mode. When the changeover lever is set at the neutral position, no hot water is jetted from the shower head.

According to the device of the present invention, therefore, the bathing person can enjoy the massage effect by a jet stream of hot water at any part of his body, changing the fixing position of the holder.

The device according to the invention can have cam surfaces which are shaped such that the lever is rotated to the hot-water jetting position only when the shower head is completely inserted into the holder, and to the neutral or hot-water showing position when the head is pulled out of the holder. Even when the shower head which is jetting a stream of hot water is pulled out of the holder in this case, the jetting of hot water can be automatically stopped or switched to the showering of hot water, thereby enabling quite a high safety to be guaranteed.

DETAILED DESCRIPTION OF THE PREFERRED EMBODIMENTS

Some embodiments of the present invention will be described with reference to the accompanying drawings.

The term "shower" used in this specification represents jetting only hot water through the shower head and the term "jet" denotes jetting a mixed liquid of hot water and air through the shower head. The term "shower" must be therefore distinguished from the term "jet" throughout the specification.

Figure 1:
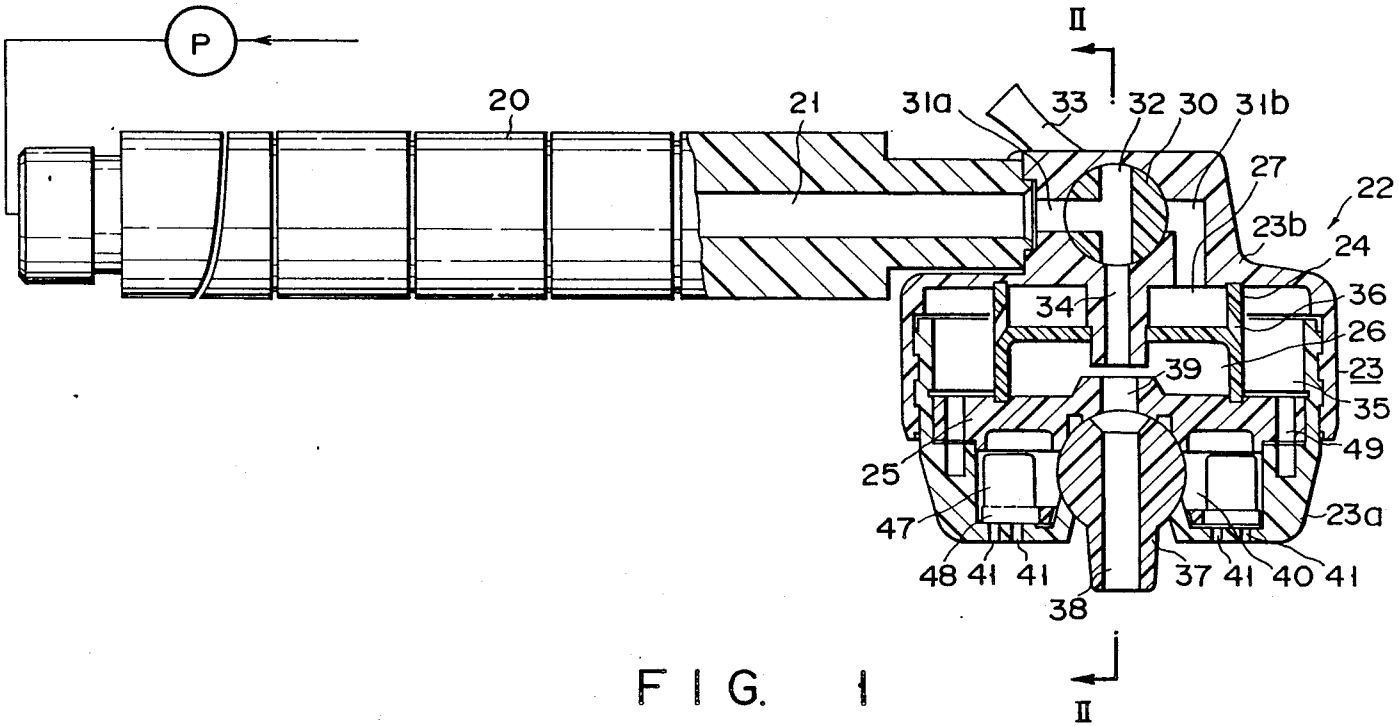
FIG. 1 is a sectional view showing an example of the massage-action shower head according to the present invention connected to a flexible pipe.

FIG. 1 shows an example of the massage-action shower head according to the present invention. Housing 23 comprises front side half 23*a* and back side half 23*b* fitted onto front side half 23*a*. Back side half 23*b* is provided with hot water entrance 31*a*, which is connected to hot water supply pump P through flexible metal pipe 20 and hose 21 which is pressed into back side half 23*b*. First partition wall member 24, H-shaped in section, and second partition wall member 25 on which first partition wall member 24 is mounted are housed in housing 23 and chamber 26 in which air and liquid are mixed is formed between both of partition wall members 24 and 25. Further, liquid chamber 27 is defined between first partition wall member 24 and back side half 23*b*. Liquid chamber 27 is communicated with liquid entrance 31*a* through changeover valve 30 and passage 31*b* in back side half 23*b*. Similarly, liquid entrance 31*a* is also communicated with air/liquid mixing chamber 26 through changeover valve 30 and passage 34 in back side half 23*b*. T-shaped passage 32 is provided in changeover valve 30 and when lever 33 connected to changeover valve 30 is swung, hot water is allowed to flow into either of passage 31*b* or 34 through hot water entrance 31*a*.

Figure 3:
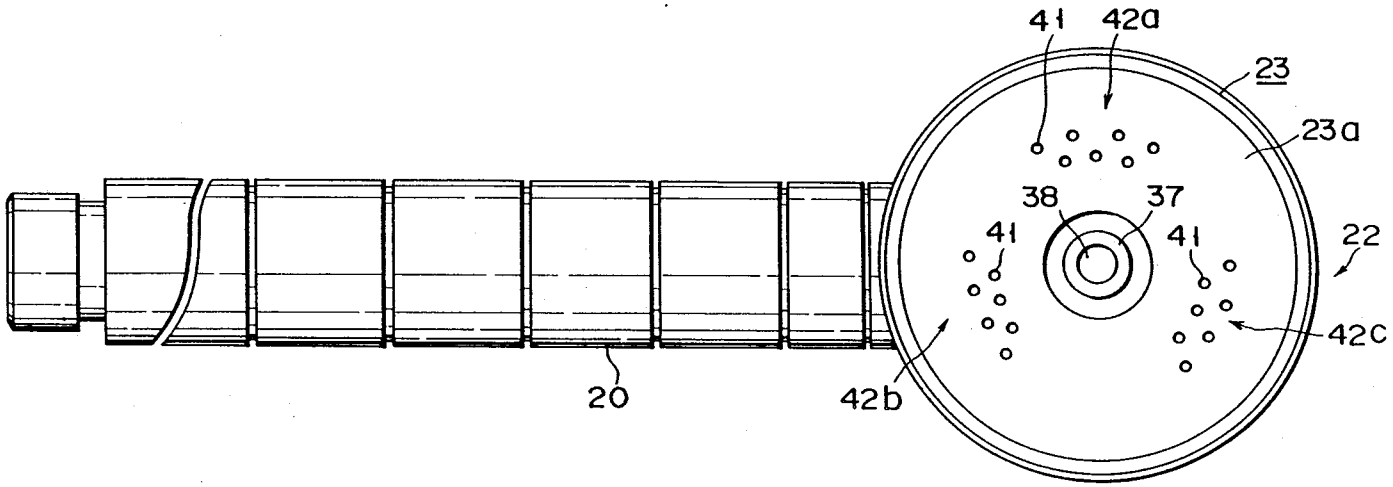
FIG. 3 is a front view showing the hot water discharging side of the shower head shown in FIG. 1.

Passage chamber 35 is defined by housing 23, first partition wall chamber 24 and second partition wall chamber 25 and it is communicated with liquid chamber 27 via through-holes 36 formed in the circumferential wall of first partition wail member 24. Valve 37 is housed, freely swingable in any direction, between second partition wall member 25 and front side half 23*a* and a hole 38 through which hot water is jetted is passed through along the center line of valve 37. This hot water jetting hole 38 is communicated with air/liquid mixing chamber 26 through hole 39 formed in the center of second partition wall member 25. Chamber 40 into which hot water flows is defined by front side half 23*a*, second partition wall member 25 and valve 37. As shown in FIG. 3, three groups 42*a*, 42*b* and 42*c* of plural shower bores 41 are arranged around hot water jetting hole 38 and at three-divided sections on the front wall or hot water jetting face of hot water flowing chamber 40.

Figure 2:
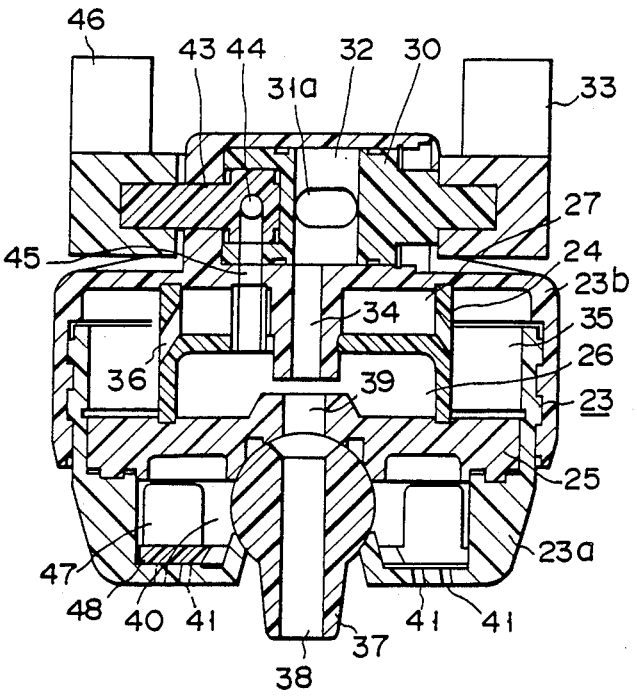
FIG. 2 is a sectional view taken along a line II—II in FIG. 1.

As shown in FIG. 2, air adjusting shaft 43 is freely swingably pivoted on back side half 23*b*. Hoie 44 through which air is introduced from outside is provided at the front end of the air adjusting shaft 43, extending perpendicular to the longitudinal direction of shaft 43, and it is communicated with air/liquid mixing chamber 26 through passage 45 in shaft 43 and back side half 23*b*. Lever 46 is attached to the back end of air adjusting shaft 43 and as air adjusting shaft 43 is swung by lever 46, that sectional area of air introducing hole 44 which is communicated with passage changes so that the amount of air introduced from outside into air/liquid mixing chamber 26 due to ejector effect can be adjusted.

A first passage line comprising passage 31*b*, liquid chamber 27, through-holes 36, passage chamber 35, passages 49 communicated and hot water flowing chamber 40 serves to introduce hot water from entrance 31*a* to shower bores 41, while a second passage line comprising passage 34 and air/liquid mixing chamber 26 serves to introduce hot water from entrance 31*a* to hot water jetting hole 38.

In FIG. 1, hot water entrance 31*a* is communicated with passage 34 through passage 32 and passage 31*b* which is communicated with liquid chamber 27 is shielded from hot water entrance 31*a* by changeover valve 30. Therefore, hot water supplied from the pump flows into air/liquid mixing chamber 26, passing through passage 34, and it is then powerfully jetted through hot water jetting hole 38, passing through passage 39 in second partition wall member 25. While hot water is being jetted through hole 38, air introduced from outside through air introducing hole 44 is sucked into air/liquid mixing chamber 26 due to ejector effect created by hot water jetted through hot water jetting hole 38 and it is mixed with hot water in air/liquid mixing chamber 26. This hot water including air is jetted, as a jetting stream of hot water, into bathtub, for example, through the hot water jetting hole 38.

When lever 33 shown in FIG. 1 is turned by 90° in the clockwise direction, passage 31*b* which is communicated with liquid chamber 27 is communicated with hot water entrance 31*a* through passage 32 and passage 34 is shielded from entrance 31*a* by changeover valve 30. Therefore, hot water supplied from the pump flows into liquid chamber 27 through passage 31*b* and then into passage chamber 35 through passage 36. It is further introduced into hot water flowing chamber 40, passing through passage chamber 35 and passages 49 in second partition wall member 25, and then showered through shower bores 41.

The showering of hot water is intermittently jetted through the shower bores of the shower head in this example to enhance the massage effect added to the body of human being. More specifically, impeller 47 is freely rotatably housed in hot water flowing chamber 40. Plural vanes are radially projected from the shaft of this impeller 47 with an interval of 120° interposed between the adjacent vanes, and shielding plate 48 having an area enough to shield one of shower bore groups 42*a*, 42*b* and 42*c* is fixed to that end of one of the vanes which is located on the hot water showering side of the shower head. Impeller 47 is rotated by the pressure of hot water flowing from the pump into hot water flowing chamber 40 and when this impeller 47 is rotated like this, shielding plate 48 of one of the vanes shields each of shower bore groups 42*a*, 42*b* and 42*c* every ⅓ rotation of impeller 47. This enables hot water to be intermittently showered outside through each of shower bore groups 42*a*, 42*b* and 42*c*.

Figure 4:
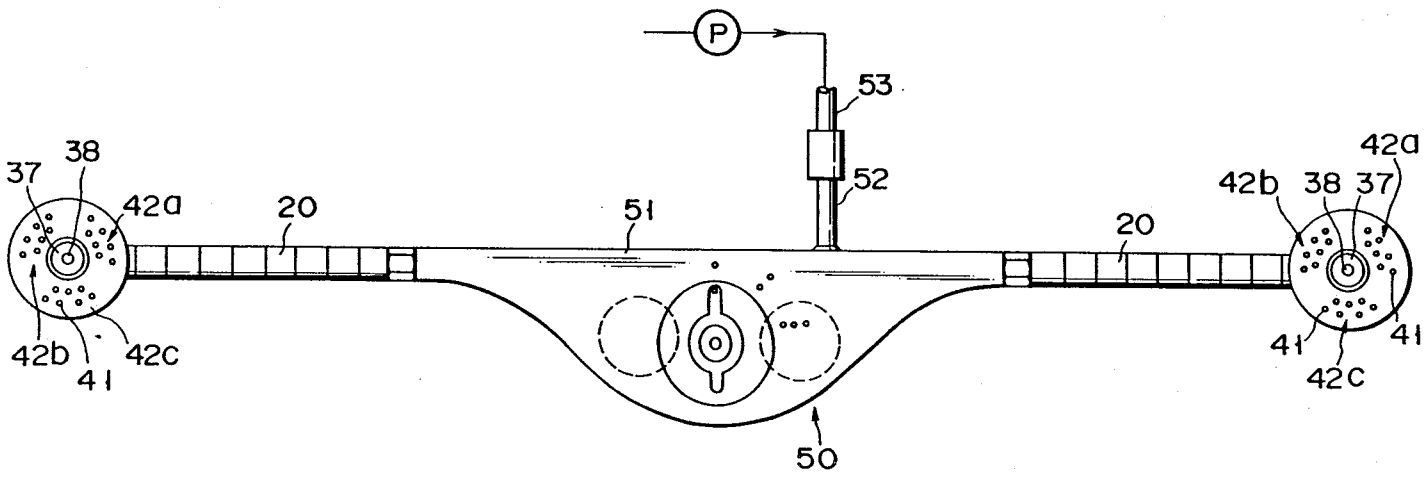
FIG. 4 is a front view showing an attachment provided with the massage-action shower heads of the present invention.

FIG. 4 shows massage-action shower heads 22 of the present invention attached to attachment 50. In FIG. 4, numeral 51 represents a body of attachment 50 from both ends of which flexible pipes 20 are extended and shower head 22 of the present invention is fixedly fitted onto the front end of each of flexible pipes 20. Flexible pipe 20 is usually called flexible hose made of metal which can change its shape freely and hold its shape whatever shape it may be changed to. Sucking disks are provided on the back side of body 51 of attachment 51, which is fixed on the wall of the bathtub by means of the sucking disks. Hot water introducing pipe 52 which is communicated with passages 21 in flexible pipes 20 is projected from attachment body 51 and connected to the pump through water supply pipe 53.

Figure 5:
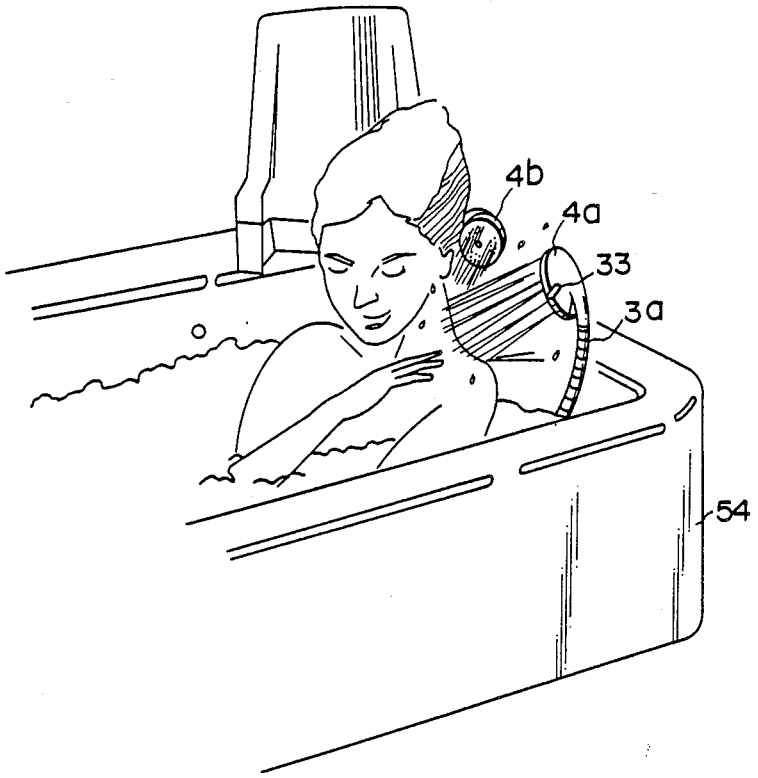
FIG. 5 is a perspective view showing a case where the massage-action shower head of the present invention is used.

FIG. 5 shows attachment 50 used in bathtub 54. Operating the lever 33, she can select either of jetting or showering of hot water to massage her stiff neck, shoulders, back and so on. Therefore, the massage effect thus attained is extremely high.

The present invention is not limited to the above-described example. Although shower bore groups 42*a*, 42*b* and 42*c*, for example, have been arranged at three-divided sections on the front face of the shower head in the above-described example, it may be arranged that shower bores 41 are arranged all over the front face of the shower head around hot water jetting hole 38. Although impeller 47 has been housed in hot water flowing chamber 40 in the above-described example to intermittently shower hot water, impeller 47 may be omitted, if necessary, to carry out the successive showering of hot water.

Although hot water jetting hole 38 has been arranged in the center of the hot water jetting face of the shower head and hot water showering bores 41 have been arranged around the hot water jetting hole 38 in the above-described example, it may be arranged that hot water showering bores 41 are gathered in and around the center of the front face of the shower head and that hot water jetting hole 38 is arranged outside these hot water showering bores 41. Hole 38 and bores 41 may be positioned as desired.

Other examples of the device used to create a jetting stream of hot water to add massage effect to the body of human being will be described with reference to FIGS. 6 through 13.

Figure 6:
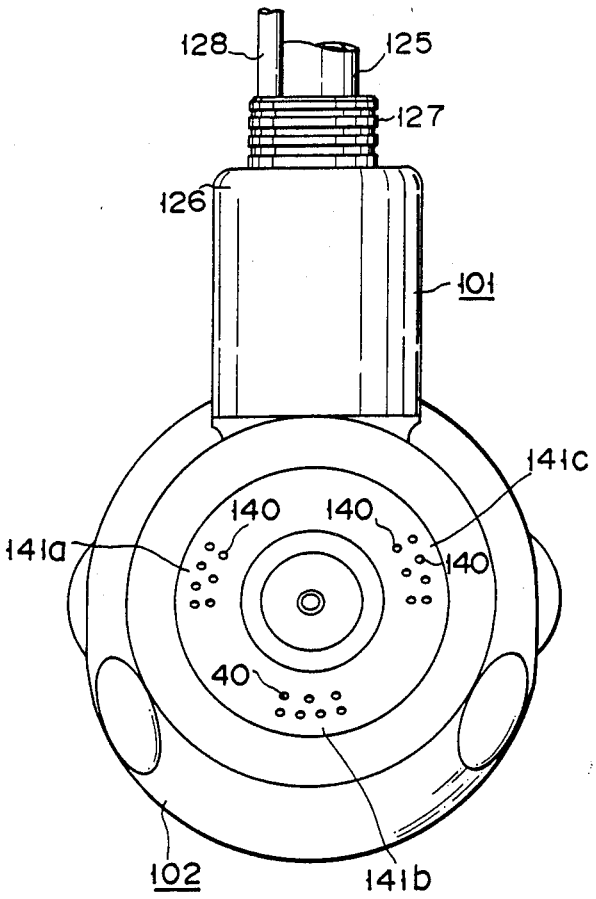
FIG. 6 is a front view showing another example of the massage-action shower head according to the present invention, said head being used together with device.
Figure 7:
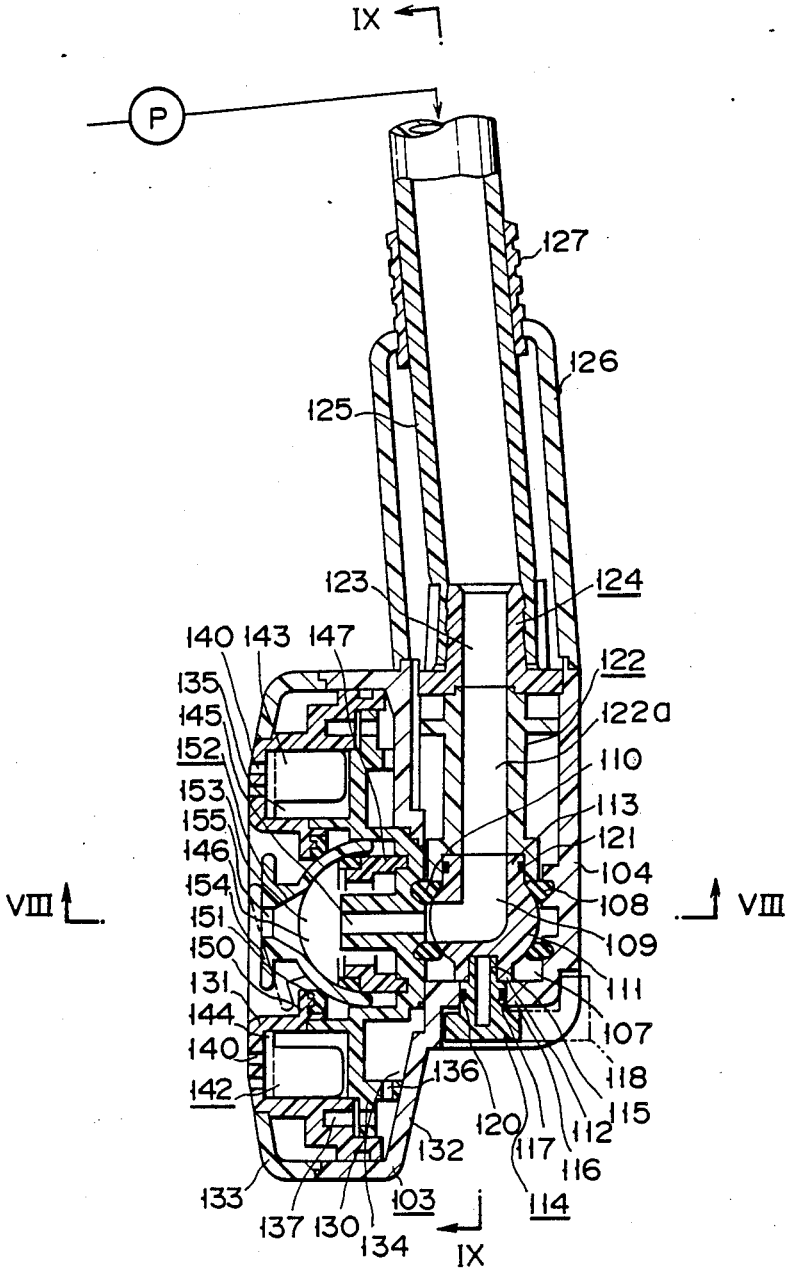
FIG. 7 is a vertically sectioned view showing the shower head in FIG. 6.
Figure 8:
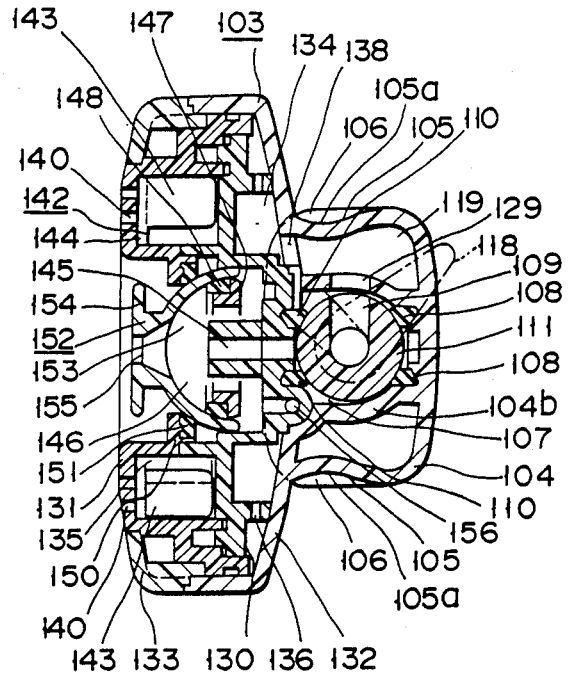
FIG. 8 is a sectional view taken along a line VII—VII in FIG. 7.
Figure 9:
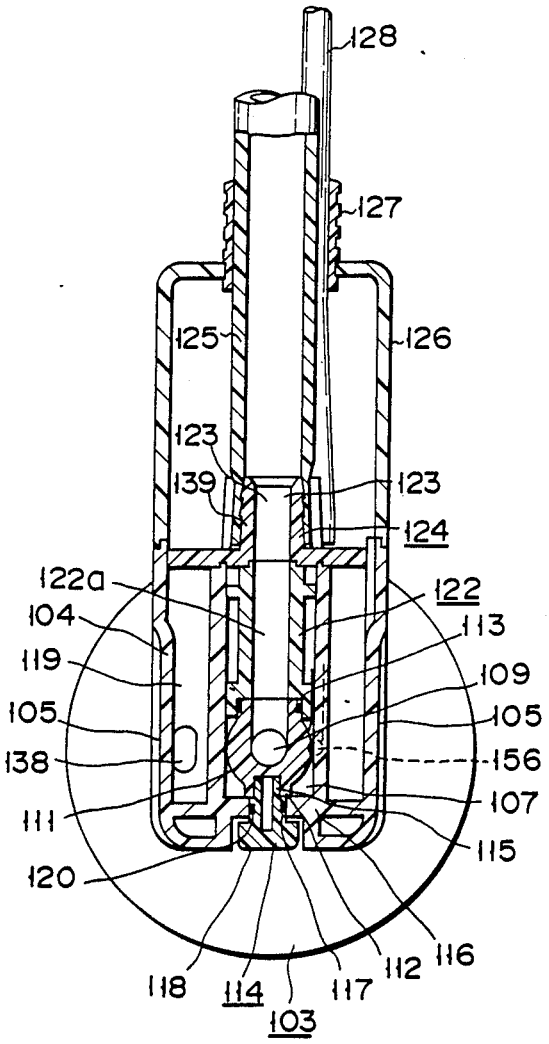
FIG. 9 is a sectional view taken along a line IX—IX in FIG. 7.

FIG. 6 shows an example of the device according to the present invention and FIGS. 7 through 9 show a shower head together with holder 102 in detail. Shower head 101 is fundamentally same as the one shown in FIG. 1 but has a special structure which enables shower head 101 to be combined with holder 102.

In FIGS. 7 through 9, attachment section 104 is provided on the back side of housing 103 of shower head 101. Both sides of attachment section 104 are concaved to form sliding engagement faces 105 but they are projected outside further than these sliding engagement faces 105 at their front to form collar-like stoppers 106 (FIG. 8).

Valve housing chamber 107 is defined by partition walls 104*a* and 104*b* in attachment section 104. Passage space 119 is formed between partition wall 104*a* and the outer wall of attachment section 104 and valve hole 129 through which passage space 119 is communicated with valve housing chamber 107 is formed in partition wall 104*a*. Bulb-like changeover valve 111 is held in valve housing chamber 107 by means of positioning packings 108 and seal packings 110 which also serves as positioning seals. L-shaped passage 109 is formed in changeover valve 111, which is provided with shaft portions 112 and 113 at the both sides thereof (FIG. 7). One end of swing rod 115 for changeover lever 114 is fixedly fitted into shaft portion 112 of changeover valve 111 while the other end of swing rod 115 is projected outside through shaft hole 117 in front end wall 116 of attachment section 104, and engagement 118 extends, perpendicular to swing rod 115, from the outside-projected front end of swing rod 115. Changeover lever 114 is made short not to be easily swing by fingers to that position where a jetting stream of hot water can be created. Packing 120 is provided between shaft hole 117 and swing rod 115 to seal valve housing chamber 107 from outside.

One end of holder sleeve 122 is fitted onto shaft portion 113 through packing 121. The collar of cap body 124 having center hole 123 through which hot water enters into the shower head is fixedly fitted into the base side of valve chamber 107 and the other end of holder sleeve 122 is fixed to center hole 123 of cap body 124. Cap body 124 is provided with connector sleeve 139, to which hose 125 extending to pump P is connected. One end of holder case 126 is fitted to the base side of attachment section 104, while the other end thereof holds hose 125 through rubber sleeve 127. The passage of hose 125 is communicated with passage 109 in changeover valve 111 through center hole 123 of cap body 124 and hole 122*a* of holder sleeve 122. Numeral 128 represents a hose through which air in the bath room is introduced into shower head 101.

First and second partition walls 130 and 131 are held by front and back side halves 132 and 133 in housing 103. Hot water flowing chamber 134 is formed between back side half 132 and first partition wall 130 and impeller housing chamber 135 is formed between both of partition walls 130 and 131. Impeller housing chamber 135 is communicated with hot water flowing chamber 134 through passages 136 and 137. Through-hole 138 is formed in the wall of back side half 132 and hot water flowing chamber 134 is communicated with passage space 119 through this through-hole 138.

Groups 141a, 141b and 141c of hot water showering bores 140 are arranged on the front face of impeller housing chamber 135 at three-divided sections thereof. Impeller 142 is freely rotatably housed in chamber 135. Three vanes 143 are radially projected from the rotating shaft of impeller 142 with an interval of 120° interposed between the adjacent vanes and shielding plate 144 having an area enough to shield each of groups 141a, 141b and 141c of showering bores is attached to the base end of each of two vanes 143.

Passage 145 is formed in the center of first partition wall 130, facing open space 146 at the front side thereof. The base end of support sleeve 147 which encloses passage 145 is fixedly fitted into the front end face of first partition wall 130 and first support packing 148 made of rubber is fixed round the front end of support sleeve 147. Arm 150 is projected, adjacent to first support packing 148, from second partition wall 131 and second support packing 151 is fixed to arm 150.

Bowl- or bulb-like nozzle member 152 is arranged in open space 146. The curved circumferential wall of nozzle member 152 is air-tightly and freely slidably sandwiched between first and second support packings 148 and 151 to cover the center portion of first partition wall 130 and form air/liquid mixing chamber 153 therein. Hot water jetting hole 155 is formed in the center of the bottom of bowl-like nozzle member 152.

Air passage 156 which is communicated with air introducing hose 128 is formed in first partition wall 130. Air flowing through hole 128 is introduced into air/liquid mixing chamber 153 through this air passage 156.

Hot water supplied from pump P passes through hose 125 and enters into sleeve hole 122a in support sleeve 122. When engagement 118 of changeover lever 114 is at the position of allowing hot water to be jetted through hot water jetting hole 155, the inlet of changeover passage 109 is communicated with sleeve hole 122a while the outlet thereof is communicated with passage 145, as shown in FIG. 7. Therefore, hot water flows into air/liquid mixing chamber 153, passing through changeover passage 109 and passage 145, and it is then jetted outside through hot water jetting hole 155. Air introduced into air passage 156 is sucked this time into air/liquid mixing chamber 153 due to ejector effect and mixed with hot water in chamber 153, so that hot water containing air can be jetted outside through hot water jetting hole 155.

When engagement of changeover lever 114 is pushed to the position of allowing hot water to be showered through showering bores 140, the inlet of passage 145 is closed by changeover valve 111, as shown in FIG. 8. On the other hand, the outlet of changeover passage 109 is connected to valve hole 129. As the result, hot water supplied from the pump flows into impeller housing chamber 135, passing through valve hole 129, passage space 119, through-hole 138, hot water flowing chamber 134 and passage 136 in this order. Impeller 142 is rotated, receiving the flowing hot water on its vanes 143, and shielding plates 144 is also rotated together with impeller 142. When showering bore groups 141b and 141c, for example, are shielded by shielding plates 144, therefore, hot water is showered through showering bore group 141a which is left open. As impeller 142 is further rotated, showering bore groups 141a and 141c are closed while showering bore group 141b allows hot water to be showered there-through. When impeller 142 continues its rotation, therefore, hot water is showered alternately through one of showering bore groups 141a, 141b and 141c. The intermittent showering of hot water can be thus created.

When engagement 118 of changeover lever 114 is pushed to a neutral position, the outlet of change-over passage 109 is communicated with valve hole 129 and passage 145 through an extremely fine clearance, or in other words, it is almost closed from valve hole 129 and passage 145, as shown by a two-dot and dash line in FIG. 8. Therefore, hot water supplied from the pump is shut off by partition wall 104a.

This neutral position means that hot water is jetted through neither hot water jetting hole 155 nor hot water showering bores 140 and when engagement 118 of changeover lever 114 is at the neutral position, therefore, it is not necessarily needed that the outlet of changeover passage 109 is located at such a position as shown by a two-dot and dash line in FIG. 7. When the outlet of changeover passage 109 is located opposite to partition wall 104b, for example, hot water is completely shut off by packings 108 and 110 so that hot water cannot be jetted through any of hot water jetting hole 155 and showering bores 140.

Figure 10:
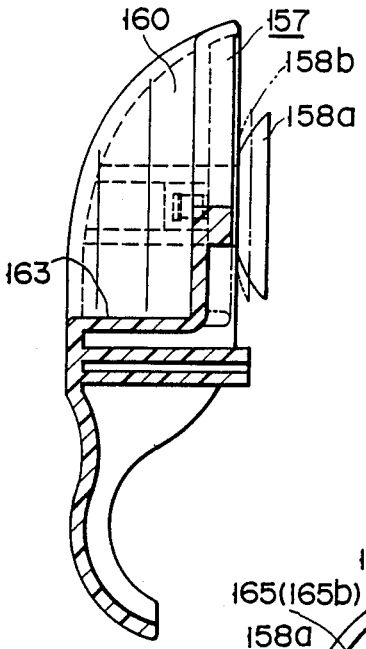
FIG. 10 is a vertically sectioned view showing a holder which is used together with the shower head shown in FIG. 6.

Holder 102 will be described referring to FIGS. 10 through 12.

An appropriate number or a pair (in this embodiment) of sucking disks 158a and 158b are fixed to the bottom of base 157 made of synthetic resin, keeping their sucking faces directed outward.

Groove 160 into which attachment section 104 is fitted is formed on the top of base 157 at the front side thereof. Both sides 161 of groove 160 are shaped to receive engaging faces 105 of shower head 101. More specifically, both sides 161 are curved outward to form curved faces 162 and when swelled faces 105 of attachment section 104 are fitted into groove 160 along curved faces 162, shower head 101 cannot come out of base 157 in direction E in FIG. 12. End face 163 of groove 160 serves as a stopper for shower head 101 inserted.

Guide groove 164 which extends from the front side of base 157 in an oblique direction and which serves as a means for changing over lever 118 of shower head 101 is formed on the bottom of groove 160. When attachment section 104 of shower head 101 is fitted into groove 160, lever 118 is guided along groove 164, both sides of which serves as cam faces for rotating engagement 118 of changeover lever 114 to a predetermined position.

Figure 11:
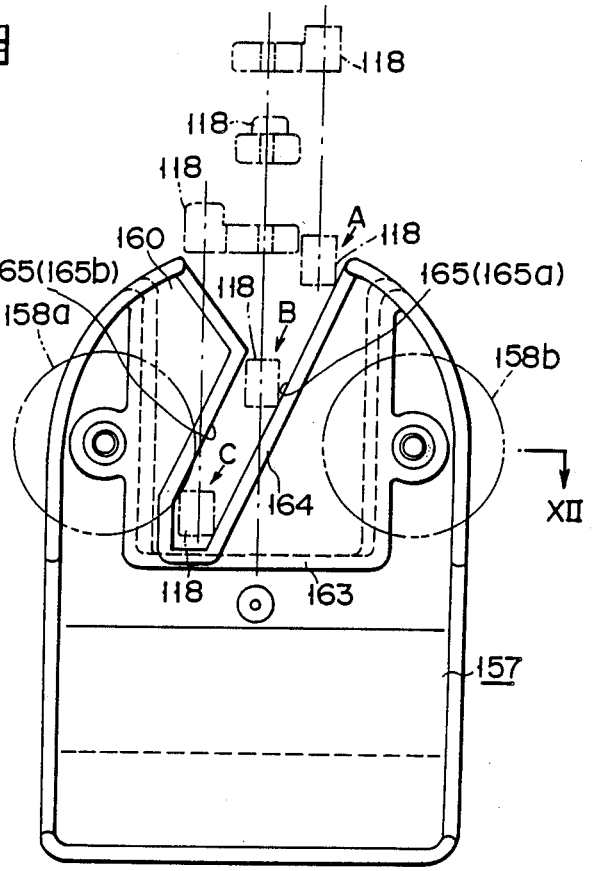
FIG. 11 shows the bottom of the holder.
Figure 12:
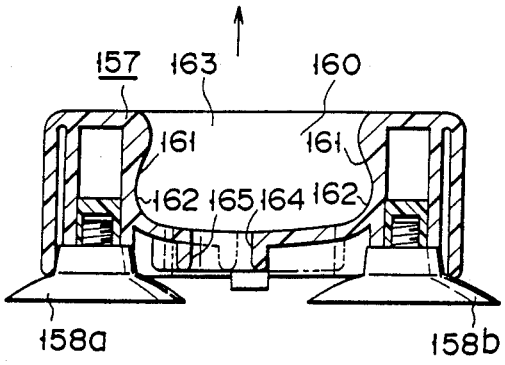
FIG. 12 is a sectional view taken along a line XII—XII in FIG. 11.
Figure 13:
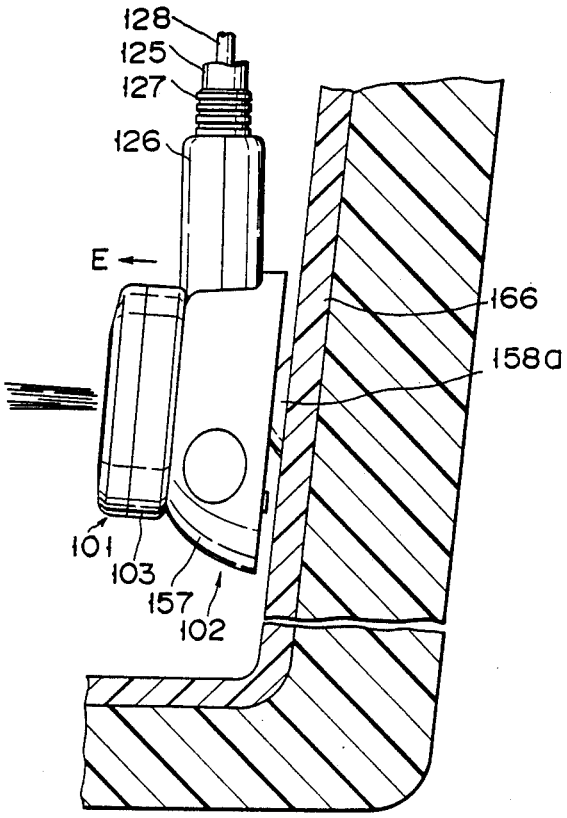
FIG. 13 is a side view showing that the holder into which the shower head has been inserted is attached to the wall of the bathtub.

As shown by phantom lines in FIG. 11, engagement 118 of changeover lever 114 is arranged at position A to allow hot water to be showered. When shower head 101 is then inserted into groove 160 and pushed downward, engagement 118 is advanced along guide groove 164 and it is rotated by cam face 165a while advancing along groove 164 and when it comes to position B, changeover lever 114 is located at the neutral position. When shower head 101 is further inserted into groove 160, engagement 118 is rotated to position C at the terminal of groove 160, locating its lever 114 at the position of allowing hot water to be jetted.

When shower head 101 is pulled out of groove 160, engagement 118 is reversely rotated by cam face 165b and when changeover lever is located at the position of allowing hot water to be showered, the pulling of shower head 101 out of groove 160 is completed. In other words, cam face 165*a* serves to rotate engagement 118 from the hot water showering position to the hot water jetting position while shower head 101 is forwarding along groove 160, and cam face 165*b* serves to rotate engagement 118 from the hot water jetting position to the hot water showering position while shower head 101 is retreating along groove 160.

Using sucking disks 158*a* and 158*b*, holder 102 can be fixed to the inner wall of bathtub 166 with the inlet of its groove 160 directed upward. The height of holder 102 in the bathtub is such that shower head 101 is kept under the surface of hot water in bathtub 166. When attachment section 104 of shower head 101 is inserted into groove 160 of holder 102 thus fixed, shower head 101 can be held on the inner wall of bathtub 166. When shower head 101 is completely held by holder 102, engagement of changeover lever 114 is automatically rotated to the hot water jetting position by cam face 165*a* and hot water is thus jetted through hot water jetting hole 155. This jetting stream of hot water adds massage effect to the body of human being in the hot water in bathtub 166.

When shower head 101 is pulled upward out of holder 102, engagement 118 is rotated to the hot water showering position by cam face 165*b*. Therefore, hot water is not jetted from shower head 101 and any danger is not caused even when that face of shower head 101 through which hot water is jetted and showered is directed to eyes and ear of human being. When shower head 101 is pulled out of holder 102 as described above, hot water is intermittently showered through showering bore groups 141*a*, 141*b*, and 141*c*. This intermittent showering of hot water adds an intermittent stimulus, different from that of the jetting of hot water, to the body of human being.

According to the above-described example, cam face 165 is shaped in such a way that engagement 118 of changeover lever 114 is rotated to the hot water jetting position when the inserting of shower head 101 into holder 10 is finished and that it is rotated to the hot water showering position when the pulling of shower head 101 out of holder 102 is finished, but cam face 165 may be shaped variously. Cam face 165 may be shaped, for example, in such a way that engagement 118 is rotated to the hot water jetting position when the inserting of shower head 101 is finished and that it is rotated to the neutral position when the pulling of shower head 101 is finished.

Further, the present invention is not limited to the above-described example. Although guide groove 164 has been formed on the bottom of groove 160, it may be formed on the side wall or others of groove 160, depending upon how changeover lever 114 is attached to shower head 101.

Although the jetting and intermittent showering of hot water have been selectively created through the front face of shower head 101, it may be arranged that only one of the jetting and intermittent showering of hot water is generated through the front face of shower head 101.

When only the jetting of hot water is generated through the front face of shower head 101, cam face 165 may be shaped in such a way that engagement 118 of changeover lever 114 is rotated to the hot water jetting position when the inserting of shower head 101 into groove 160 of holder 102 is finished and that it is rotated to the neutral position (where hot water is not jetted) when the pulling of shower head 101 is finished. When shower head 101 is arranged to generate only the intermittent showering of hot water cam face 165 may be shaped in such a way that engagement 118 of changeover lever 11 is rotated to the neutral position (where hot water is not showered) when the inserting of shower head 101 is finished relative to holder 102 and that it is rotated to the hot water showering position when the pulling of shower head 101 is finished. When cam face 165 is shaped like this, it is made possible that massage effect is added to the body of human being by the intermittent showering of hot water, holding shower head 101 by hand but without operating changeover lever 114, after shower head 101 is pulled out of holder 102.

When holder 102 is used, fixing it to the inner wall of the bathtub above the surface of hot water therein, cam face 165 may be shaped in such a way that engagement 118 of changeover lever 114 is rotated to the hot water showering position when the inserting of shower head 101 is finished relative to holder 102 and that it is rotated to the neutral position when the pulling of shower head 101 is finished. When shower head 101 is inserted into holder 102 in this case, the intermittent showering of hot water is automatically generated through hot water showering bores 140 and it can be applied to the neck and so on of human being without using her hand, thereby enabling massage effect to be added to her neck and so on by the intermittent showering of hot water. As described above, it can be selected whether hot water is jetted or showered through shower head 101, and cam face 165 can be shaped depending upon how hot water is discharged outside through shower head 101.

Although the intermittent showering of hot water has been generated in the above-described example, the continuous showering of hot water may be created. Impeller 142 housed in chamber 135 may be omitted in this case.

It should be understood that the present invention is not limited to the above-described examples but that various changes and modifications can be made without departing from the scope of claims appended hereto.

What is claimed is:

1. A shower head device capable of providing massage effect to a human body by a jet of hot water, comprising a shower head having an entrance for hot water and a face through which hot water is discharged outside, said hot water discharging face being provided with a plurality of bores through which hot water is showered and a hole through which hot water is jetted; a changeover lever projected outside from said shower head and communicating said hot water entrance with at least one of said hot water showering bores and said hot water jetting hole; a holder fixed to an inner wall of a bathtub and detachably holding that side of said shower head which is opposite to the hot water discharging face of said shower head; and a means for switching said changeover lever to different positions when said shower head is attached to and detached from said holder.

2. The device according to claim 1, wherein said shower head has an attachment section formed on that side of said shower head opposite to the hot water discharging face thereof and having parallelly arranged engaging faces swelled outside at that side of said shower head remote from the hot water discharging face thereof, said holder has a groove into which the attachment section of said shower head is inserted from one end of said groove and said groove is made open at that side thereof which is remote from the inner wall of the bathtub and has receiving faces with which said engaging faces are slidably contacted and an end face for limiting insertion of said attachment section.

3. The device according to claim 2, wherein said receiving faces of the holder have such faces that are curved to correspond to the engaging faces of the attachment section of said shower head.

4. The device according to claim 3, wherein said changeover lever of the shower head has an engagement projected in a direction reverse to the hot water discharging face and can be rotated in the traverse direction relative to the engaging faces.

5. The device according to claim 4, wherein said holder has a bottom which closes said groove on the side of the inner wall of the bathtub, a guide groove into which said changeover lever is fitted when said attachment section of said shower head is inserted into said guide groove provided on the bottom of said groove and said guide groove has a cam for rotating said changeover lever while attachment section is being moved in said groove.

6. The device according to claim 5, wherein said changeover lever can be moved to one of a hot water showering position where said hot water entrance is communicated with the hot water showering bores, a hot water jetting position where said hot water entrance is communicated with the hot water jetting hole, and a neutral position where said hot water entrance is shut off from said hot water showering bores and said hot water jetting hole, and said cam of the guide groove comprises a cam face for rotating said changeover lever to the hot water jetting position when said attachment section of the shower head is inserted into the groove and another cam face for rotating said changeover lever from the hot water jetting position to the other positions when said attachment section is pulled out of the groove.

7. The device according to claim 6, wherein said guide groove is arranged to enable the attachment section to be detached from the holder, keeping said changeover lever at the neutral position.

8. A shower head device capable of providing massage effect to a human body by jet of hot water comprising:

a housing having an entrance for hot water and a face through which hot water is discharged outside, said face being provided with a plurality of bores through which hot water is showered and a hole through which hot water is jetted;

a first passage line formed in said housing and being capable of communicating said hot water entrance with a plurality of hot water showering bores;

a second passage line formed in said housing and being capable of communicating said hot water entrance with a hot water jetting hole;

an air introducing hole provided in said housing for introducing air from outside to said second passage line;

a shower head having a changeover lever for communicating said hot water entrance with at least one of said first passage line and said second passage line;

a holder capable of being fixed to an inner wall of a bathtub and detachably holding that side of said shower head which is opposite to the hot water discharging face of said shower head; and switching means for switching said changeover lever to different positions when said shower head is attached to and detached from said holder.

9. The device according to claim 8, further comprising a flexible pipe member, one end of which is connected to said housing and having a passage for feeding hot water supplied from a pump to the entrance of said housing.

10. The device according to claim 8, further comprising an attachment detachably fixed to the inner face of a bathtub and to which the other end of at least one flexible pipe can be fixed.

11. A device used to provide massage effect to a human body comprising:

a shower head having an entrance for hot water and a face through which hot water is discharged, said hot water discharging face being provided with a plurality of bores through which hot water is showered and a hole through which hot water is jetted;

a changeover lever projected outside from said shower head and communicating said hot water entrance with at least one of said hot water showering bores and said hot water jetting hole;

a holder fixed to an inner wall of a bathtub and detachably holding that side of said shower head which is opposite to the hot water discharging face of said shower head; and means for switching said changeover lever to different positions when said shower head is attached to and detached from the holder.

* * * * *